US007750725B2

(12) United States Patent
Jan

(10) Patent No.: US 7,750,725 B2
(45) **Date of Patent: *Jul. 6, 2010**

(54) STABILIZING METHODS FOR CURRENT SOURCE

(75) Inventor: Shiun-Dian Jan, Taipei County (TW)

(73) Assignee: Princeton Technology Corporation, Taipei County (TW)

( * ) Notice: Subject to any disclaimer, the term of this patent is extended or adjusted under 35 U.S.C. 154(b) by 397 days.

This patent is subject to a terminal disclaimer.

(21) Appl. No.: 11/984,786

(22) Filed: Nov. 21, 2007

(65) Prior Publication Data

US 2009/0045793 A1 Feb. 19, 2009

(30) Foreign Application Priority Data

Aug. 16, 2007 (TW) ..... 96130309 A

(51) Int. Cl.
*G05F 3/26* (2006.01)

(52) U.S. Cl. ..... 327/538; 327/343; 323/315

(58) Field of Classification Search ..... 323/312–316; 327/538–543, 573; 326/68, 83; 330/253, 330/252, 257

See application file for complete search history.

(56) References Cited

U.S. PATENT DOCUMENTS

| | | | | |
|---|---|---|---|---|
| 5,012,133 A * | 4/1991 | Hughes | ..... | 327/91 |
| 5,572,161 A * | 11/1996 | Myers | ..... | 327/538 |
| 6,586,976 B2 * | 7/2003 | Yang | ..... | 327/157 |
| 6,683,489 B1 * | 1/2004 | Eker | ..... | 327/538 |
| 6,995,604 B2 * | 2/2006 | Puma et al. | ..... | 327/543 |

* cited by examiner

*Primary Examiner*—Rajnikant B Patel
(74) *Attorney, Agent, or Firm*—Muncy, Geissler, Olds & Lowe, PLLC

(57) ABSTRACT

A stabilizing current source circuit is provided. The stabilizing current source circuit is used for stabilizing a current provided by a current source, and the current of the current source increases when temperature rises. The stabilizing current source circuit comprises a current source circuit and an adjustment circuit. The current source circuit provides a current that increases when temperature rises. The adjustment circuit is coupled to the current source circuit and provides an input current that increases when temperature rises. The current of the current source is subtracted from the input current to generate a current source current which does not vary with temperature.

7 Claims, 3 Drawing Sheets

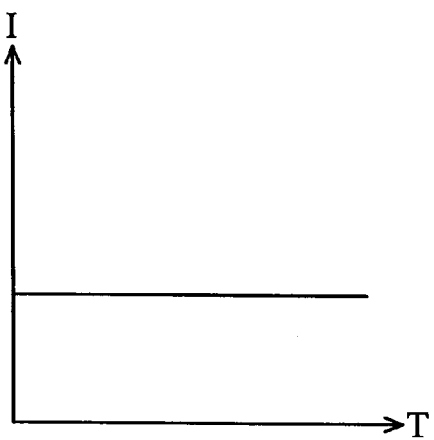
FIG. 3a
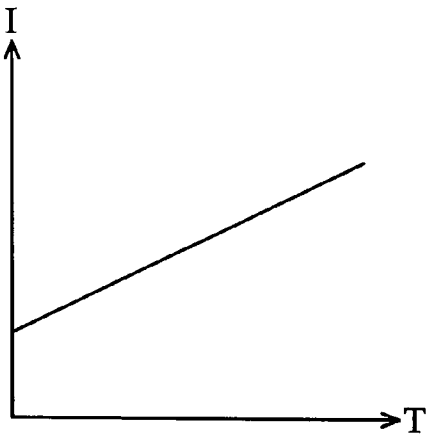
FIG. 3b
FIG. 3c

STABILIZING METHODS FOR CURRENT SOURCE

BACKGROUND OF THE INVENTION

1. Field of the Invention

The invention relates to a stabilizing method for a current source, and more particularly to a stabilizing method for a current source which provides a current varying with temperature.

2. Description of the Related Art

For integrated circuit design, reference voltages and reference currents are required, wherein the reference voltages and the reference currents are usually included in a bias part of the integrated circuit. For general applications, the bias part of an integrated circuit is designed according to operating temperature of the integrated circuit. However, variations in operating temperature are not considered for the design of the bias part.

During the operation of integrated circuits, operating temperature varies according to ambient temperature variation or heat generated by electronic elements within the integrated circuit. Operating temperature variations may affect signal transmitting operations of the integrated circuit so that the transformed signals have noise due to the operation temperature variation. For example, an analog-to-digital converter is affected by temperature noise. Moreover, a microprocessor with a sensor is more sensitive to temperature variations, thus, temperature variations also affects operations of microprocessors with sensors.

In general, bipolar junction transistors (BJTs) are used to design integrated circuits having temperature variation. There is a logarithmic relationship between base-emitter voltage $V_{BE}$ and collector current $I_C$ of a BJT and the base-emitter voltage $V_{BE}$ is affected by temperature variation. The relationship between the base-emitter voltage $V_{BE}$ and the temperature variation is represented by the following:

$$V_{BE}(H,I_C)=E_{GE}-H(E_{GE}-V_{BEN})+V_{TH}H\log(I_C/I_N)-\eta V_{TH}H\log H \quad \text{(Function 1)}$$

wherein, $H=T/T_N$, and T represents absolute temperature, and $T_N$ represents standardized temperature. $T_N$ is usually a middle value of an operating temperature range, such as 300K (27°). $E_{EG}$ represents an assumed value of the base-emitter voltage $V_{BE}$ at absolute zero (zero degree Kelvin), or about 1.14V to 1.19 V. $V_{BEN}$ represents a value of the base-emitter voltage $V_{BE}$ when junction temperature of a BJT is equal to the specific value $T_N$ and collector current $I_C$ is equal to a specific value $I_N$. $V_{TN}$ represents a value of thermal voltage (=kT/q) at the standardized temperature $T_N$. η represents a curve constant, about 2 to 4.

FIG. 1 shows a line diagram of Function 1. Referring to FIG. 1, showing characteristics of BJTs, the base-emitter voltage $V_{BE}$ decreases when temperature rises and increases when collector current $I_C$ increases. BJTs are usually applied in circuits, wherein when there is a rise in temperature, current increases, achieving current balance so that the current remains at a constant value.

However, since diodes are required in a BJT circuit, requirement for a BJT circuit increases hardware costs and device/element volume. Thus, it is desired to provide an alternative method for stabilizing a current source.

BRIEF SUMMARY OF THE INVENTION

An exemplary embodiment of a stabilizing current source circuit is provided. The stabilizing current source circuit is used for stabilizing a current provided by a current source, and the current of the current source increases when temperature rises. The stabilizing current source circuit comprises a current source circuit and an adjustment circuit. The current source circuit provides a current that increases when temperature rises. The adjustment circuit is coupled to the current source circuit and provides an input current that increases when temperature rises. The current of the current source is subtracted from the input current to generate a current source current which does not vary with temperature.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein:

FIGS. 3*a*-3*c* are diagrams of a stabilizing current process according to the embodiment of the invention.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
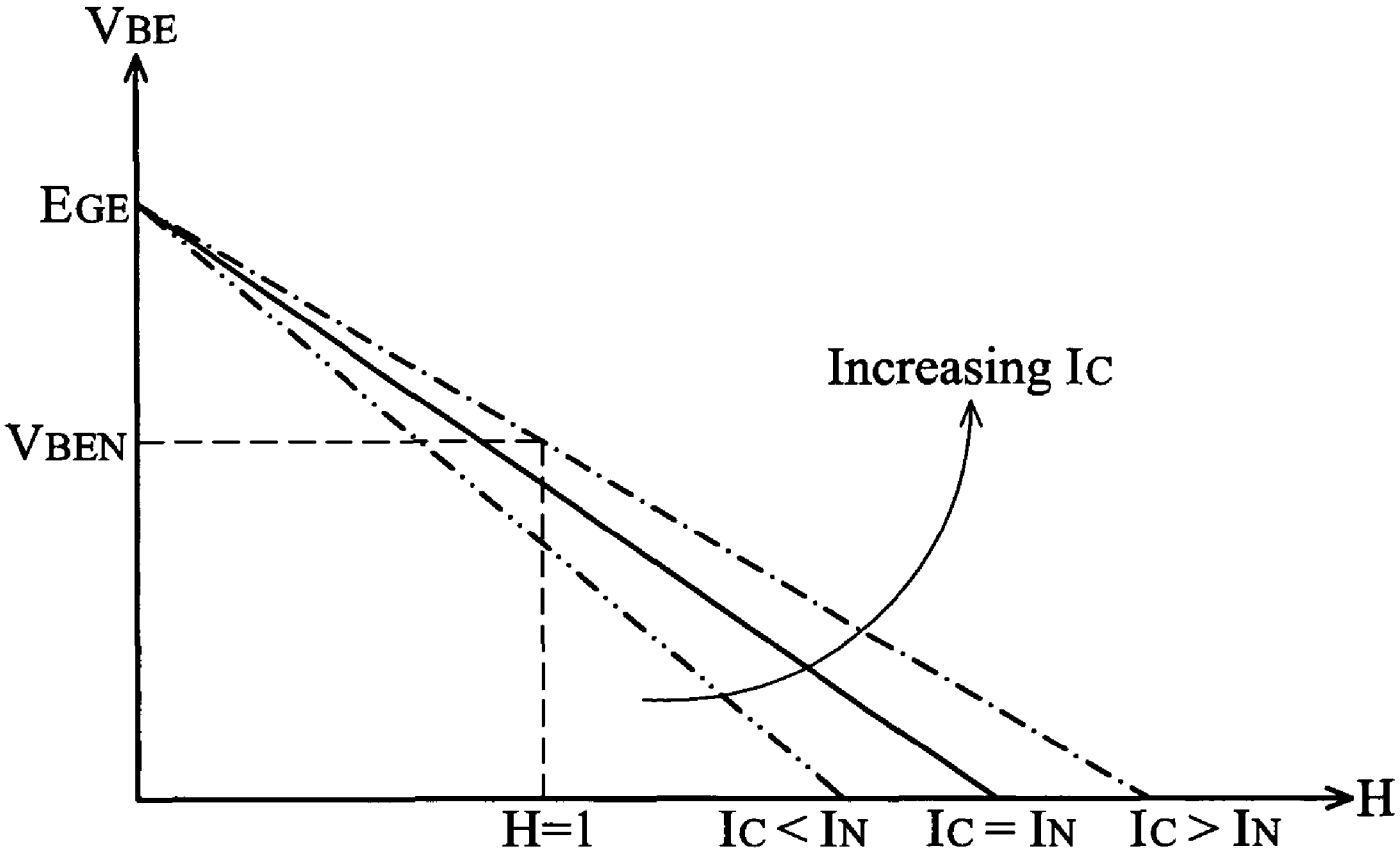
FIG. 1 (RELATED ART)
FIG. 1 shows a line diagram of Function 1.
Figure 2:
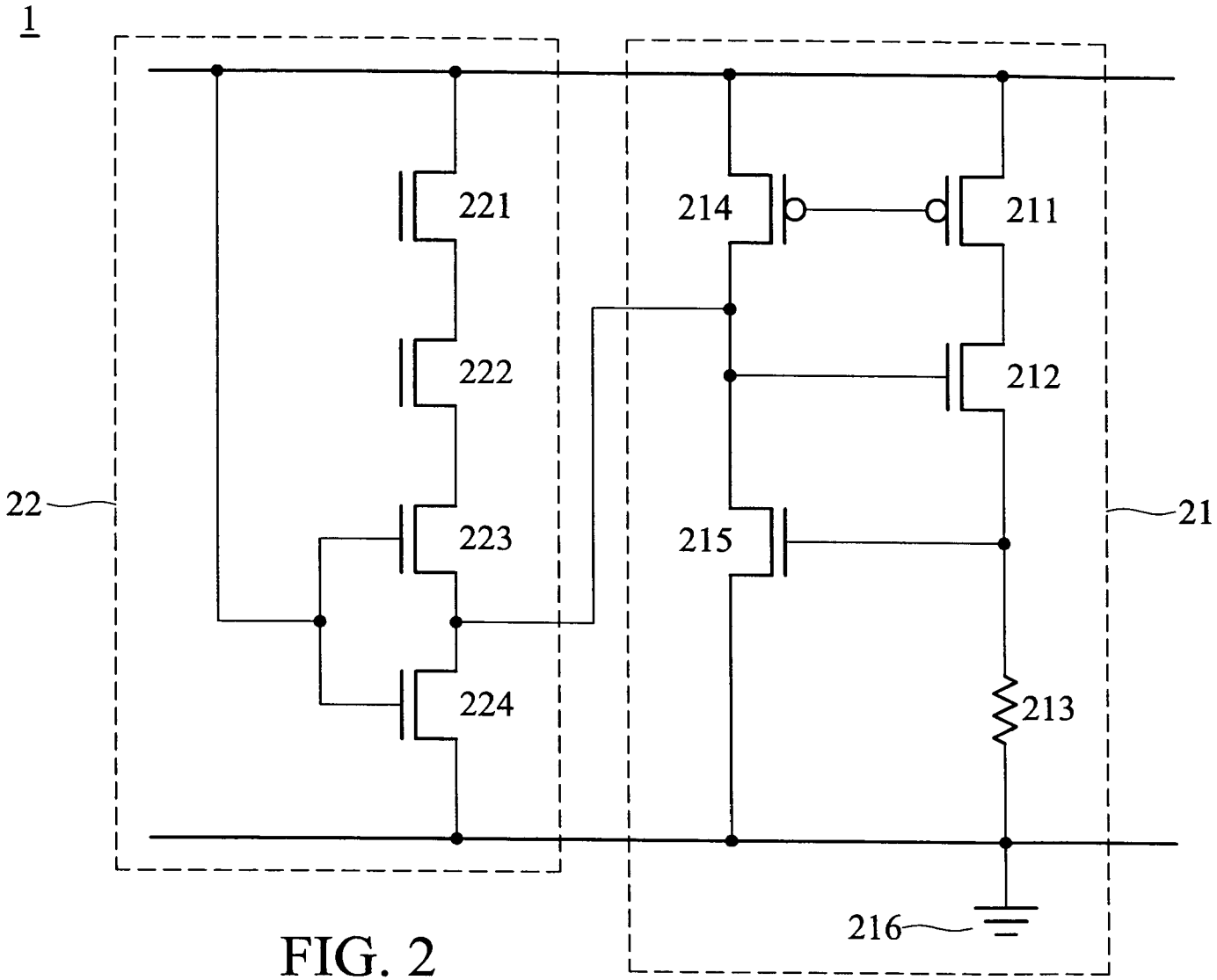
FIG. 2 shows an embodiment of a stabilizing circuit for a current source of the invention.

Stabilizing circuits for a current source are provided. In an embodiment of a stabilizing circuit 2 for a current source of the invention in FIG. 2, a stabilizing circuit 2 comprises a current source circuit 21 and an adjustment circuit 22. The current source circuit 21 comprises a P-type metal oxide semiconductor (PMOS) transistor 211, a first NMOS transistor 212, a first resistor 213, a second PMOS transistor 214, a second NMOS transistor 215, and a ground terminal 216.

The adjustment circuit 22 comprises third, fourth, fifth, and sixth NMOS transistors 221, 222, 223, and 224.

A source of the first PMOS transistor 211 is coupled to sources of the second PMOS transistor 214 and the third NMOS transistor 221, a gate thereof is coupled to a gate of the second PMOS transistor 214, and a drain thereof is coupled to a source of the first NMOS transistor 212. A gate of the first NMOS transistor 212 is coupled to a drain of the second PMOS transistor 214 and a source of the second NMOS transistor 215, and a drain thereof is coupled to one terminal of the first resistor 213 and a gate of the second NMOS transistor 215. The other terminal of the first resistor 213 is coupled to the ground terminal 216.

The drain of the second PMOS transistor 214 is coupled to the source of the second NMOS transistor 215, a drain of the fifth NMOS transistor 223, and a source of the sixth NMOS transistor 224. A drain of the second NMOS transistor 215 is coupled to the ground terminal 216.

A drain of the third NMOS transistor 221 is coupled to a source of the fourth NMOS transistor 222. A drain of the fourth NMOS transistor 222 is coupled to a source of the fifth NMOS transistor 223. The drain of the fifth NMOS transistor 223 is coupled to the source of the sixth NMOS transistor 224. A drain of the sixth NMOS transistor 224 is coupled to the ground terminal 216. A gate of the fifth NMOS transistor 223 is coupled to a gate of the sixth NMOS transistor 224 and further to the sources of the third NMOS transistor 221, the second PMOS transistor 214, and the first PMOS transistor 211.

The current source circuit 21 can be a self-biasing MOSFET Vt reference current source for providing a current to serve as a current source. The adjustment circuit 22 can be a start-up circuit for providing an input current. Given bandgap reference voltage and the characteristic where input current increases when temperature rises, before the current of the current source circuit 21 is input, the adjustment circuit 22 subtracts the current of the current source circuit 21 from the input current. The MOS transistors in the adjustment circuit 22 can adjust a rising ratio of the input current with temperature to be the same as a rising ratio of the current of the current source circuit 21 with temperature. Accordingly, after the input current is subtracted from the current of the current source circuit 21, an output current of the stabilizing circuit 2 has a stable value, so that the output current will not increase when temperature rises or decreases when temperature falls, wherein the output current of the stabilizing circuit 2 is referred to as a current source current. Thus, the current source circuit 21 is more stable since the effect of temperature variation for output current is eliminated, FIGS. 3*a*-3*b* is a diagram of a stabilizing current process according to the embodiment of the invention. FIG. 3*a* is a relationship diagram between the current provided by current source circuit 21 and temperature, and FIG. 3*b* is a relationship diagram between the input current of the adjustment circuit 22 and temperature. In FIGS. 3*a* and 3*b*, the vertical axes represent current magnitude, and the horizontal axes represent temperature. A relationship coefficient between the current and the temperature in FIG. 3*a* is same as that in FIG. 3*b*. FIG. 3*c* is a relationship diagram between the output current and temperature after the input current is subtracted from the current of the current source circuit 21. Referring to FIG. 3*c*, the value of the output current is constant and does not vary with temperature.

In above embodiment, the four NMOS transistors in the adjustment circuit 22 are given as an example, without limitation. The current source circuit 21 is not limited to a self-biasing MOSFET Vt reference current source.

According to the embodiment of the invention, the stabilizing circuit 2 does not use conventional BJT circuit and diodes therein, thus, saving hardware costs and hardware space.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A stabilizing current source circuit for stabilizing a current provided by a current source, the current of the current source increasing when temperature rises, and the stabilizing current source circuit comprising:

a current source circuit providing a current that increases when temperature rises; and an adjustment circuit coupled to the current source circuit, providing an input current that increases when temperature rises;

wherein the current of the current source is subtracted from the input current to generate a current source current which does not vary with temperature.

2. The stabilizing current source circuit as claimed in claim 1, wherein a rising ratio of the input current with temperature is the same as a rising ratio of the current of the current source with temperature.

3. The stabilizing current source circuit as claimed in claim 1, wherein the current source is a self-biasing MOSFET Vt reference current source.

4. The stabilizing current source circuit as claimed in claim 1, wherein the adjustment circuit is a start-up circuit.

5. The stabilizing current source circuit as claimed in claim 1, wherein the adjustment circuit comprises a plurality of metal oxide semiconductor (MOS) transistors.

6. The stabilizing method as claimed in claim 5, wherein a number of the MOS transistors of the adjustment circuit is used to adjust the rising ratio of the input current with temperature.

7. The stabilizing method as claimed in claim 1, wherein the adjustment circuit does not comprise diodes.

* * * * *